United States Patent [19]

Asselborn et al.

[11] Patent Number: 5,031,494

[45] Date of Patent: Jul. 16, 1991

[54] WEB PROCESSING MACHINE HAVING AT LEAST ONE WEB AND ROLL AND A SLITTER FOR SAID WEB

[75] Inventors: Peter Asselborn, Bergisch-Gladbach; Dietmar Berzbach, Nümbrecht, both of Fed. Rep. of Germany

[73] Assignee: Kampf GmbH & Co. Maschinenfabrik, Wiehl, Fed. Rep. of Germany

[21] Appl. No.: 463,039

[22] Filed: Jan. 10, 1990

[51] Int. Cl.[5] ..... B26D 7/18

[52] U.S. Cl. ..... 83/100; 83/24; 83/504; 493/342; 144/252 R

[58] Field of Search ..... 83/100, 24, 498, 499, 83/500, 502, 504, 478; 493/342; 144/252 R, 252 A

[56] References Cited

U.S. PATENT DOCUMENTS

| | | | |
|---|---|---|---|
| 413,606 | 10/1889 | Mefford | 144/252 R |
| 3,135,151 | 6/1964 | Link | 83/100 |
| 4,576,072 | 3/1986 | Terpstra | 83/478 |
| 4,704,930 | 11/1987 | Bodewein | 83/100 |

FOREIGN PATENT DOCUMENTS

| | | | |
|---|---|---|---|
| 6398 | 3/1932 | Australia | 144/252 R |
| 444041 | 5/1927 | Fed. Rep. of Germany | . |

*Primary Examiner*—Daniel C. Crane
*Attorney, Agent, or Firm*—Herbert Dubno

[57] ABSTRACT

A web-slitting machine has its blades mounted on cylinders shifted along a linear guide extending the full width of the web to be slit. The sliders carry tubes whose suction nozzles are disposed in the regions of the blades and which terminate in connecting heads having boat-shaped projections received between elastomeric sealing lips closing a slit of a suction box extending along the guide.

8 Claims, 3 Drawing Sheets

WEB PROCESSING MACHINE HAVING AT LEAST ONE WEB AND ROLL AND A SLITTER FOR SAID WEB

FIELD OF THE INVENTION

Our present invention relates to a machine for the processing of webs of flexible material, e.g. a material which is supplied on a roll or which can be taken up onto a roll and which includes means for slitting the web and for drawing off the debris formed by slitting.

BACKGROUND OF THE INVENTION

Roll cutting machines are known in which a web delivered by a roll, displaced along a transport path and wound up again on a roll can be slit longitudinally as the web is displaced along the path.

Such a machine can comprise, in addition to the supply roll and the take up roll, a guide, e.g. a rail arrangement, running transversely to the direction of displacement of the web and a blade arrangement including a blade and a counter blade, e.g. rotatable blades which are mounted on at least one slide displaceable along the guide to allow adjustment of the widths of the web portions into which the web is subdivided.

In such arrangements it is a common practice to provide a suction pipe with a suction nozzle or mouth for each such blade and a plurality of such blades and respective slides on the common guide rail.

During slitting, the formation of dust and other debris is unavoidable and the suction nozzle serves to collect the debris which is thus formed.

The formation of such dust and debris is particularly common where the web is a foil, especially a foil provided with a magnetic coating of the type to be slit into magnetic tape.

The collection of the dust by suction is substantially imperative if the dust, because of its high abrasive quality and its tendency to adhere to the foil and other surfaces, is not to pose a problem. Indeed, it is impossible to operate under the requirements of a clean room in the absence of such suction removal of the dust.

In the prior art systems used for collecting or removing the cutting dust, it is customary to provide suction nozzles at the cutting blades which are connected by hose-like suction lines with suction fittings.

Upon an adjustment of the cutting blade to another position, e.g. so as to vary the cutting width or for other setup work or maintenance, the suction pipe is usually disconnected from the suction fitting since the suction fitting is usually fixedly positioned and does not permit sufficient shifting of the particular slide. The suction pipe must then be fitted onto another suction fitting. As a consequence, the setup time is comparatively long and the setup operation requires numerous manipulative procedures.

OBJECTS OF THE INVENTION

It is the principal object of the present invention to provide a roll slicing or slitting machine for web materials and for the longitudinal slitting of a web which can avoid the aforedescribed drawbacks.

Another object of the invention is to provide an improved suction arrangement for the blade slide or carriage of such a machine which enables continuous connection of the suction nozzle associated with a blade during the repositioning thereof so that additional setup work and setup time is not required for bringing the suction nozzle into operation.

SUMMARY OF THE INVENTION

These objects and others which will become apparent hereinafter are attained, in accordance with the present invention by providing a suction box in a machine of the aforedescribed type with a suction slit parallel to the aforementioned guide and by providing each suction pipes so that it has a respective connecting fitting slidable along the suction slit. The connecting member and pipe can be rigidly joined to the slide so as to move therewith.

The connecting head of each pipe can have a ship or boat shaped portion engaged between the sealing lips of the slip and with a longitudinal axis parallel to the suction slit.

The resilient lips, prestressed against one another to seal the slit until the boat-shaped portion of the connecting head spreads them apart, engage opposite flanges or side (side walls) of the portion of the connecting head which can be a projection received between these lips.

The system of the invention, therefore, can be distinguished from the prior art in that a rigid pipe can form the suction duct and can be connected to the slide and to the connecting head so that the slide, pipe and head move along the suction slit and guide together.

The boat-shaped configuration of the projection on the connecting head ensures both an effective seal between the suction slit and the connecting head and an effective evacuation of the cutting dust, while also insuring an effective seal of the slit in the regions between slides.

A seal which automatically adjusts to the position of the slide and will effectively engage the connecting head is insured by forming the lips on sealing bars which may be provided in one piece, i.e. unitarily, with the lips.

Especially effective shifting of the suction head between the lips is assured by having the elongated projection of the head shaped so that its flanges converge toward the opposite ends, e.g. to respective tips.

More specifically, the web slitting machine of the invention can comprise:

means including a roll of a web for defining a path for the web in a direction of longitudinal travel thereof;

an elongated guide extending transversely to the direction across the web;

a suction box having a suction slit extending generally parallel to the guide and provided with two resiliently deformable sealing lips extending along the slit and sealing the slit where the lips are not held apart;

at least one slide shiftable along the slide and having a blade cooperating with a counterblade along the path for slitting the web longitudinally as the web is displaced in the direction;

a respective suction tube fixed to the slide and having an inlet for evacuating slitting debris positioned close to the blade; and a connecting head slidable along the suction box together with the slide and having a connecting fitting communicating with the tube, the connecting head having a portion of generally boat-shaped cross section fitting between the lips, communicating between the slit and the fitting, elongated in a direction in which the slit extends, and having sides engaged by the lips.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
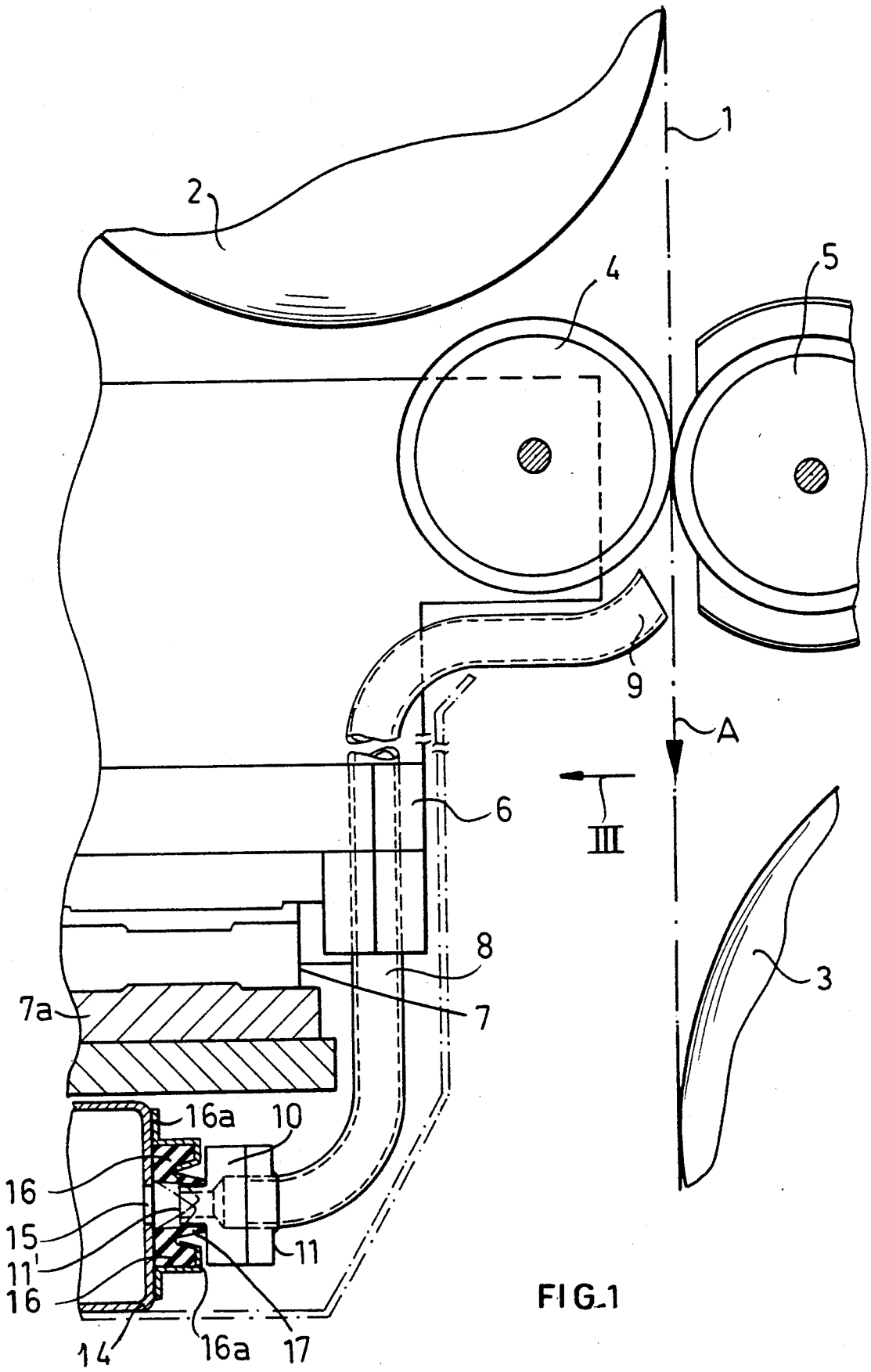
FIG. 1 is a schematic cross sectional view, taken from a side, through a web-slitting machine according to the invention.

As can be seen from the drawing, a web 1, for example a foil and especially a foil which can be cut into strips like magnetic tape, passes over a supply roll 2 which may be a deflecting roll of the web processing machine and is guided around a further deflecting roll 3 to, for example, a roll winding machine in which the web sections subdivide by slitting the web longitudinally can be wound up. Between the rolls 2 and 3, the web runs in a transport path defined by the arrow A, i.e. in a web fitted longitudinal direction. In the embodiment illustrated, the web path is vertically downwardly.

Figure 3:
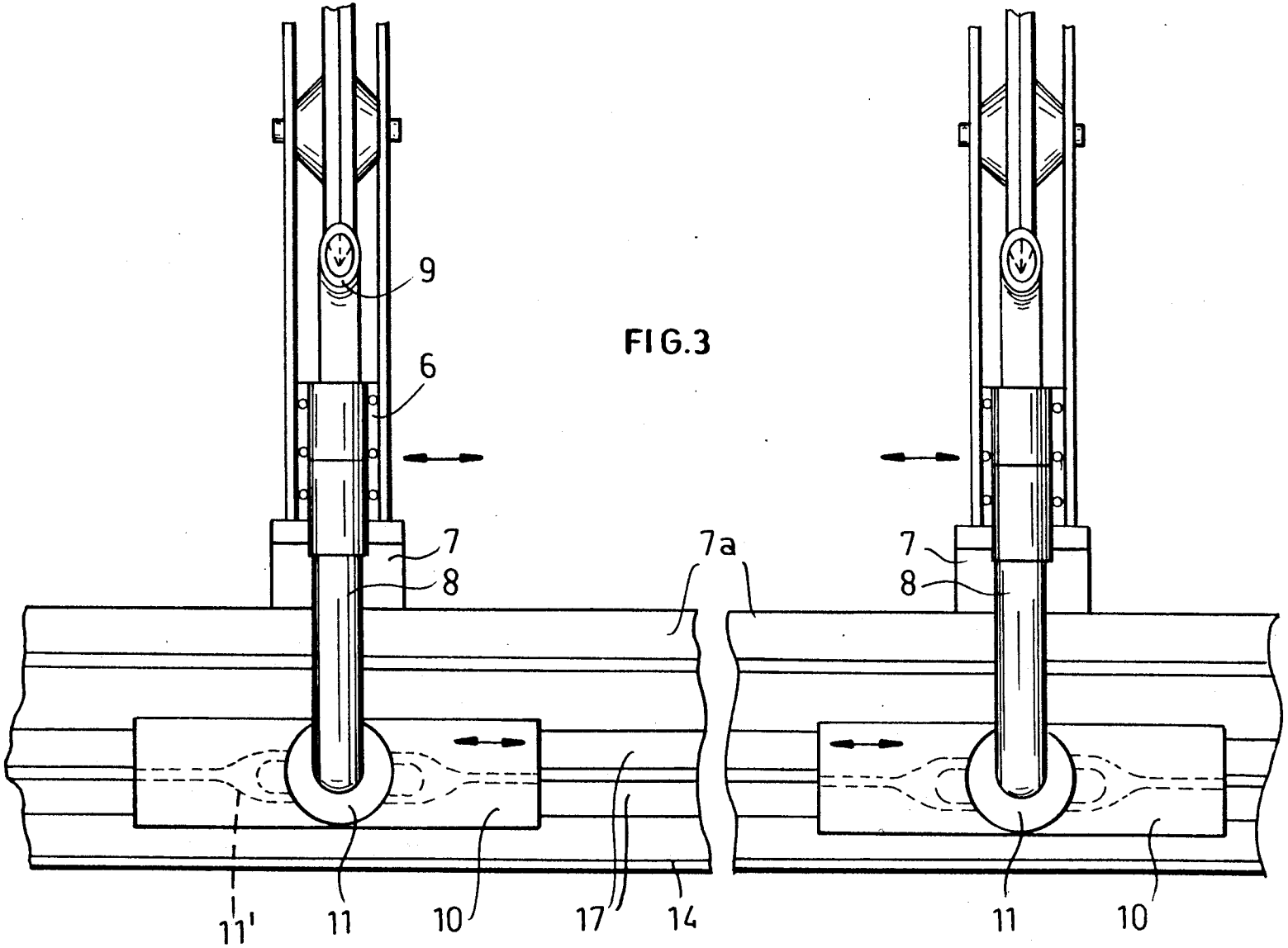
FIG. 3 is a fragmentary elevational view taken in the direction of the arrow III in FIG. 1 of the apparatus of the invention.

Over the width of the web path in spaced apart relationship transversely of the direction of arrow K, there are a plurality of cutting or slitting stations (two of which can be seen in FIG. 3), each of which has a cutting blade 4 and a counter blade 5 so positioned as to slit the web longitudinally.

The arrangement of the blades has been illustrated only schematically.

Each cutting blade 4 is mounted upon a slide 6 and each slide 6 has a guide member 7 which is suitable on a rail 7*a* which extends the full width of the web to be slitted. Thus the sliders 6 can be positioned at any desired location along the rail 7*a* to cut, in conjunction with the blades of other sliders, the web 1 into appropriate widths. The drives for the sliders 6 and the blades 4 have not been illustrated. The counterblades 5 can be mounted upon respective sliders shiftable along a linear rail in a similar manner although such elements have not been illustrated.

On each cylinder 6, a tube 8 is affixed. The tube 8 has a suction nozzle or mouth each trained upon the cutting region at which the cutting blade and counterblade shear the web between them to collect cutting debris and dust. The tube 8 can be a substantially rigid element which can be rigidly fixed to the slider 6.

Each tube 8 carries a correcting head 11 which is provided with a fitting 11 connected to the respective tube 8 and with a projection 11' which has a boat-shaped cross section.

Figure 2:
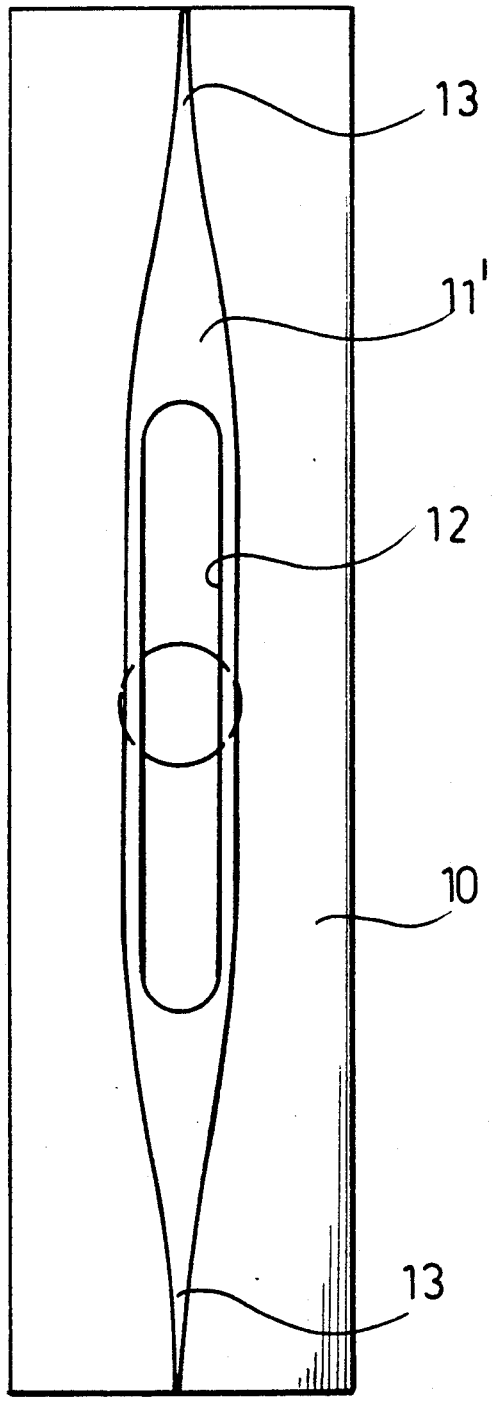
FIG. 2 is an elevational view of the connecting head.

The boat-shaped configuration is especially clear from FIG. 2.

Within the projection 11', an elongated or slot shaped mouth 10 is provided which communicates with the fitting 11 and the tube 8. The ends of the projection 11' have flanges which converge toward one another longitudinally to form tips 13. The longitudinal axis of the mouth 12 lies transversely to the web 1 and parallel to the linear guide 7*a*.

The apparatus also includes a suction box 14 which extends parallel to the linear guide 7 and is further over its entire length with a suction slit 15. Sealing bars 16 of elastomeric material are mounted by means, e.g. via brackets 16*a* which can be bolted or otherwise affixed to the suction box 15.

The sealing bars 16 have elastomeric lips 17 formed unitarily therewith and biased by inherent resiliency against one another further that, where these lips 17 do not press against the projections 11', they bear with prestress against one another and thus close the suction slit 15. The closed position of the lips 17 has been in broken lines in FIG. 1.

The boat-like head thus engages between the lips 17 and holds them apart over the lengths of the projections 11'. In the regions of the tips 13, the lips close against each other to maintain the vacuum within the suction box 14. As each slide 6 is moved in one direction or the other during adjustment or maintenance of the slitting machine, the respective head 10 likewise is drawn along between the lips in the same direction, the lips 17 renewing their sealing engagement with flanges of the projection 11' while the head maintains communication between the respective tube 8 and the suction box.

We claim:

1. A web-slitting machine comprising:

means including a roll of a web for feeding said web along a path in a direction of longitudinal travel;

an elongated guide extending transversely to said direction across said web;

a suction box having a suction slit extending generally parallel to said guide and provided with two resiliently deformable sealing lips extending along said slit and sealing said slit where said lips are not held apart;

at least one slide shiftable along said slide and having a blade cooperating with a counterblade along said path for slitting said web longitudinally as said web is displaced in said direction, said shifting of said slide permitting said blade positioning across said web;

a respective suction tube fixed to said slide and having an inlet for evacuating slitting debris positioned close to said blade; and a connecting head slidable along said suction box together with said slide and having a connecting fitting communicating with said tube, said connecting head having a portion of generally boat-shaped cross section, taken in a plan view fitting between said lips and elongated in a direction in which said slit extends, and having sides engaged by said lips so as to hold said lips apart, said portion being slidable along said lips while maintaining communication between said suction box and said suction tube at said fitting and with said lips sealing said slit in the region not held apart by said portion.

2. The web-slitting machine defined in claim 1 wherein said lips are connected to respective sealing bars.

3. The web-slitting machine defined in claim 1 wherein said portion has flanks engaged by said lips converging toward opposite ends of said portion substantially to respective tips.

4. The web-slitting machine defined in claim 3 wherein said lips are connected to respective sealing bars secured to said suction box.

5. The web-slitting machine defined in claim 4 wherein said sealing bars are composed of elastomeric material and said machine further comprises attachment members engageable over said sealing bars.

6. The web-slitting machine defined in claim 5 wherein said lips converge in a direction away from said suction box.

7. The web-slitting machine defined in claim 6 wherein said path is defined between a roller adapted to supply said web and a roller guiding portions of said web separated from one another by the slitting of said web.

8. The web-slitting machine defined in claim 7 wherein said inlet of said tube is located below a region at which said blade and said counterblade engage said web.

* * * * *